US006786266B2

(12) United States Patent
Fukada

(10) Patent No.: US 6,786,266 B2
(45) Date of Patent: Sep. 7, 2004

(54) WASTE PEELING APPARATUS

(75) Inventor: Koichi Fukada, Osaka (JP)

(73) Assignee: K. K. Mashintex (JP)

( * ) Notice: Subject to any disclaimer, the term of this patent is extended or adjusted under 35 U.S.C. 154(b) by 0 days.

(21) Appl. No.: 10/102,492

(22) Filed: Mar. 20, 2002

(65) Prior Publication Data

US 2002/0108709 A1 Aug. 15, 2002

Related U.S. Application Data

(63) Continuation-in-part of application No. 09/865,132, filed on May 24, 2001, now abandoned.

(30) Foreign Application Priority Data

| | | |
|---|---|---|
| May 26, 2000 | (JP) | 2000-155601 |
| Mar. 26, 2001 | (JP) | 2001-86795 |
| Apr. 3, 2001 | (JP) | 2001-104019 |
| Jul. 2, 2001 | (JP) | 2001-200269 |

(51) Int. Cl.[7] ..... B32B 35/00

(52) U.S. Cl. ..... 156/584; 156/248; 156/267; 156/344

(58) Field of Search ..... 156/247, 248, 156/267, 344, 584

(56) References Cited

U.S. PATENT DOCUMENTS

| | | | | |
|---|---|---|---|---|
| 3,522,136 A | * | 7/1970 | Williams et al. | 156/584 |
| 4,282,056 A | * | 8/1981 | Okui | 156/519 |
| 4,599,125 A | * | 7/1986 | Buck | 156/248 |
| 4,809,602 A | * | 3/1989 | Wheeler | 100/35 |
| 4,820,369 A | | 4/1989 | Kubo | |
| 5,062,582 A | * | 11/1991 | Harmon et al. | 242/412.2 |
| 5,466,321 A | | 11/1995 | Miyaji | |
| 6,547,913 B1 | * | 4/2003 | Libby et al. | 156/248 |

* cited by examiner

*Primary Examiner*—Mark A. Osele
(74) *Attorney, Agent, or Firm*—Hahn Loeser & Parks, LLP; Michael H. Minns

(57) ABSTRACT

A waste peeling apparatus for separating the waste part of a continuous web material where a peeling member is positioned skewed to the direction of travel of the web.

29 Claims, 10 Drawing Sheets

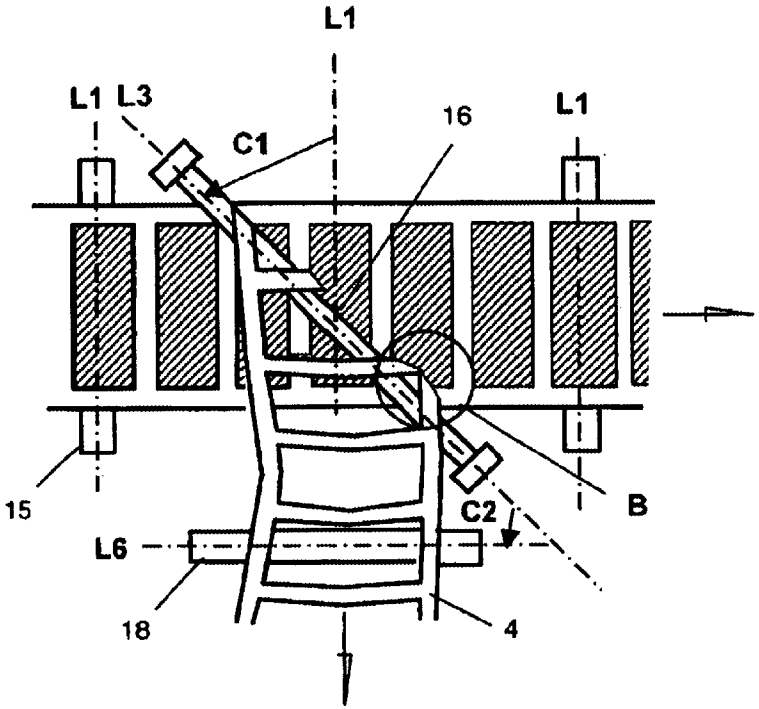
Fig. 12
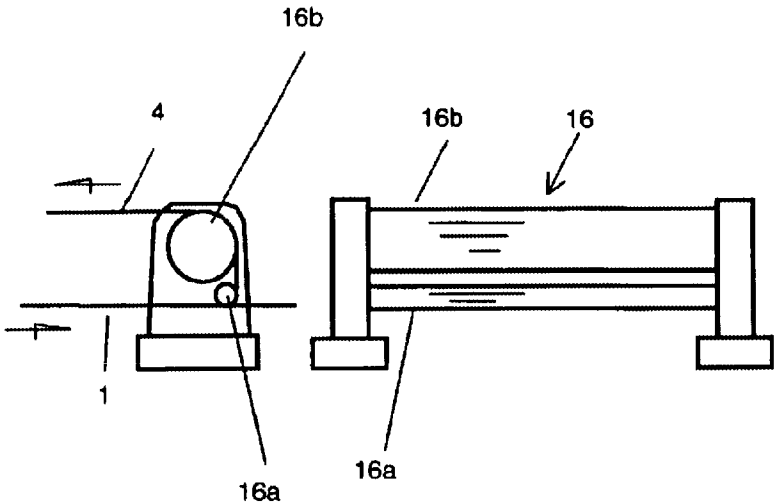
Fig. 11A
Fig. 11B

WASTE PEELING APPARATUS

This application is a continuation-in-part of U.S. patent application Ser. No. 09/865,132, filed May 24, 2001 now abandoned.

BACKGROUND OF THE INVENTION

This invention relates generally to a waste peeling apparatus for separating the waste part of a continuous web material (or web waste) from the continuous web material (or web).

In the manufacture of labels, a laminated web, having an upper layer over-lying a substrate, is fed from an unwind roll to the processing machine. The web is such that the upper layer is adhered to the substrate by a suitable adhesive, but is easily stripped or peeled from the substrate without damage to either layer. The compositions of the layers are such that nearly all the adhesive remains with the upper layer so that a label can be peeled off the substrate and then placed on the object to which it is to be applied such as a container or the like.

The processing machine into which the laminated web is fed, may have several stations which perform various operations on the web as the web travels there-through. For example, there may be one or more printing stations, cross-perforating, line hole punching, die-cutting, and matrix stripping. It is the matrix stripping operation to which this invention relates.

In a die-cutting station, the upper layer of the web is die-cut by a rotating die and/or reciprocating dies which penetrates the laminate but not the substrate. This leaves a die-cut pattern defining the shape of the labels, and a waste matrix or web waste. At a stripping station, the waste matrix is removed or separated from the web leaving only the substrate and the label portions which may then be further processed onto a rewind roll, by folding, by sheeting, or the like. It is readily appreciated that productivity is directly related to machine speed, and that the machines can be operated at a speed only as fast as the station with the least capability. Thus, if one station cannot exceed a certain speed, the entire machine will have to be run at that speed even though other stations will operate faster. One of the weak links as far as operating speed is concerned has been the stripping station, and this is particularly so where the waste matrix is relatively weak.

The configuration and strength of the waste matrix depends on the die pattern which, because of some job requirements, leaves a relatively weak matrix that breaks quite easily or tends to "ride" to the center of the rewind roll. For example, if the matrix includes vertical strands of substantial width, its strength will be sufficient to allow relatively high speed operation, but if there are very few longitudinal strands and they are quite thin, the matrix will easily break and the speed of the machine will have to be reduced substantially to prevent such breakage. Also, if there are only two outside longitudinal strands with no longitudinal strands therebetween, these strands tend to move toward each other causing the waste matrix roll to bulge at the center.

FIG. 1 shows a waste peeling apparatus or stripper according to the prior art. Web 1, entering from the left side as seen in FIG. 1, passes over guide rollers 2 and reaches peeling roller 3. At this point, web material 1*a* is separated from waste matrix 4, and is transported from guide roller 5*a*, around and in contact with a non-slip outside surface of drive roller 7, which is rotationally driven by a variable speed drive motor 6, and then around guide roller 5*b* to a next process, such as a rewinding process.

While the speed of web 1 can be adjusted by drive motor 6, tension must be applied in order to stably transport the web 1 and stably separate the waste matrix 4 from web 1. One way of applying this tension, shown in FIG. 1, is with a brake roller shaft 8 having an outside surface of a non-slip material, such as cork. Rotation of shaft 8 is adjusted by means of a magnetic particle brake 9. This adjustment maintains appropriate tension on web 1 from the brake roller shaft 8 to the drive roller 7, and enables the waste matrix 4 to be stably separated from the web 1.

After the waste matrix 4 is separated by peeling roller 3, which is positioned where the tension on web 1 is stable, waste matrix 4 is wound around the outside of a waste take-up core 12 mounted on a waste take-up shaft 11 that is driven by a torque motor 10, thereby forming a waste roll 13 of waste matrix 4.

Because of problems with its strength, the separated waste matrix 4 can not be stably wound up by applying high tension to the waste matrix, as is possible with other common roller materials. As a result, some means is conventionally used to prevent excessive take-up drive tension from being applied to the waste matrix 4 after separation, such as, taking up the waste matrix 4 using a torque motor that slows rotation when the load exceeds a set torque level.

As shown in FIG. 2, a large part of the separated waste matrix 4 is generally a structure of consecutive holes 4*x* of which the perimeter is defined by narrow border or longitudinal members 4*y* and cross members 4*z*. Because the waste take-up shaft 11 is conventionally disposed to the other rollers 2, 8, 5*a*, 5*b*, 7, tension for separation can only be applied to the waste matrix 4 in the direction of the arrows, that is, only to longitudinal members 4*y*, when separating the web 1 and the waste matrix 4, and cross member 4*z* is separated only by indirect force transmitted as an effect of the tension on longitudinal member 4*y*. As a result, separation is delayed at the middle of cross member 4*z* where the tension effect of the longitudinal member 4*y* is least, and cross member 4*z* can not be evenly and simultaneously separated from web 1.

A peeling roller or stripper 3, or fixed member such as a separating plate, is interposed for actual waste separation, as shown in FIG. 3, for the purpose of assisting separation. However, when the waste matrix 4 is shaped as shown in FIG. 3, and particularly when the longitudinal members 4*y* are narrow and the cross member 4*z* is long, the waste matrix 4 twists due to the delayed separation of the cross member 4*z*. Stress concentrates at A, and the waste matrix 4 tears easily.

Various efforts have been made to resolve this problem, including making the longitudinal members 4*y* wide enough so that the waste matrix 4 does not tear easily, or reinforcing the waste matrix 4 by including fibers in the web material. Such measures are, however, expensive and time consuming, and are, therefore, only used in limited applications. It is, therefore, difficult to increase the efficiency of the overall process because the waste matrix 4 must be separated at a speed that will not cause the waste matrix 4 to tear. More particularly, when the shape of the waste matrix 4 makes tearing especially easy, it may be necessary to remove the waste matrix 4 manually rather than using a peeling machine to separate the waste matrix 4. This requires much manual labor to peel and then dispose of the waste matrix 4, which becomes very bulky after it is peeled and manually wound up.

With the prior art peeling methods, there is also a strong possibility that the product 14 will also be picked up, as shown in FIG. 4, in conjunction with the waste matrix 4 when the waste matrix 4 is peeled. Attempts to resolve this problem have included using an acute peeling angle B and modifying the shape of the peeling roller 3. However, while product pickup become less likely with as the peeling angle becomes more acute, the waste matrix 4 tends to tear more easily with more acute peeling angles. The problem of this product pickup and the problem waste matrix tearing thus conflict with each other.

The foregoing illustrates limitations known to exist in present waste matrix strippers. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing a stripper for separating a waste matrix from a web, the stripper comprising: a waste matrix peeler positioned at a skewed angle to the direction of travel of the web; and a waste matrix guide roller positioned laterally sideways from an edge of the web.

It is a primary purpose of the present invention to provide a method and apparatus for stripping the matrix from the web at speeds substantially greater than with the conventional method with a corresponding increase in productivity, and where the tendency for the rewind matrix roll to bulge is greatly reduced if not eliminated.

A means whereby the present invention achieves these objects is removing the waste matrix at an angle that is diagonal to the direction of travel of the web and then travels at an angle that is not perpendicular to the axis of the guide rollers, waste matrix cross members are peeled from the web with substantially no delay relative to the longitudinal members. It is therefore possible to significantly reduce the potential for tearing and at the same time resolve the problem of product pickup because the peeling angle can be made more acute.

The foregoing and other aspects will become apparent from the following detailed description of the invention when considered in conjunction with the accompanying drawing figures.

BRIEF DESCRIPTION OF THE DRAWING FIGURES

FIGS. 11A and 11B are front and side views of a second embodiment of a waste peeler;

FIG. 12 is a top view showing waste matrix having a tendency for width-wise contraction;

DETAILED DESCRIPTION

Figure 2:
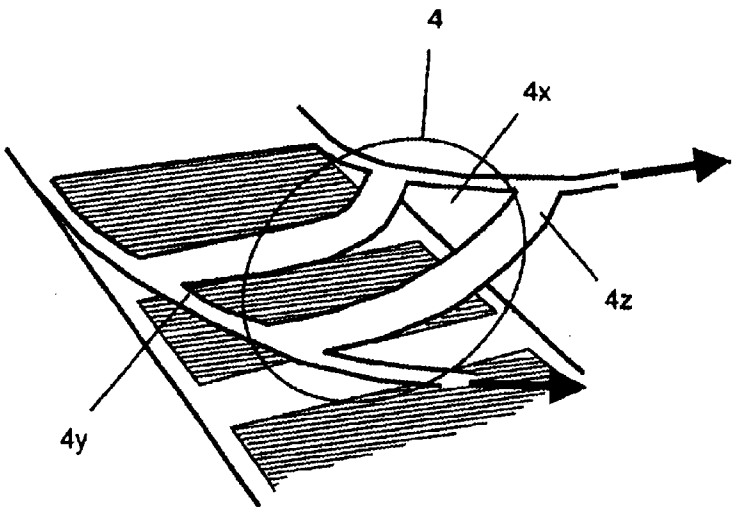
Prior Art Fig. 2
FIG. 2 is a perspective view of a peeled waste matrix.
Figure 1:
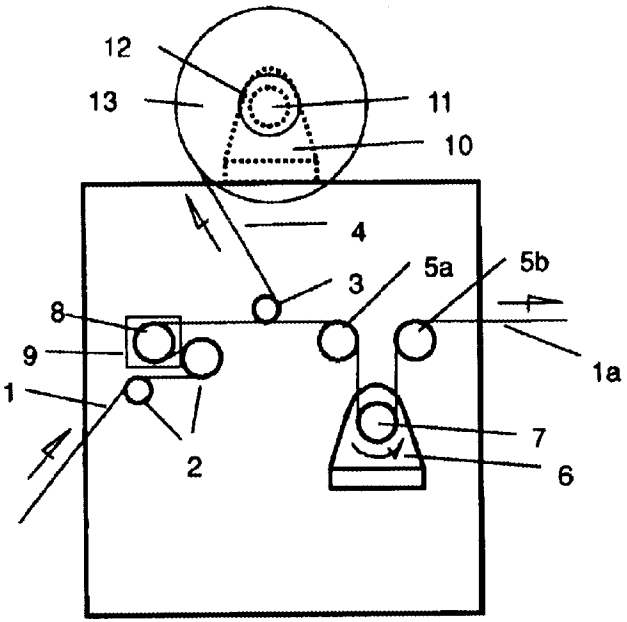
Prior Art Fig. 1
FIG. 1 is a side view of a prior art waste peeling apparatus.
Figure 4:
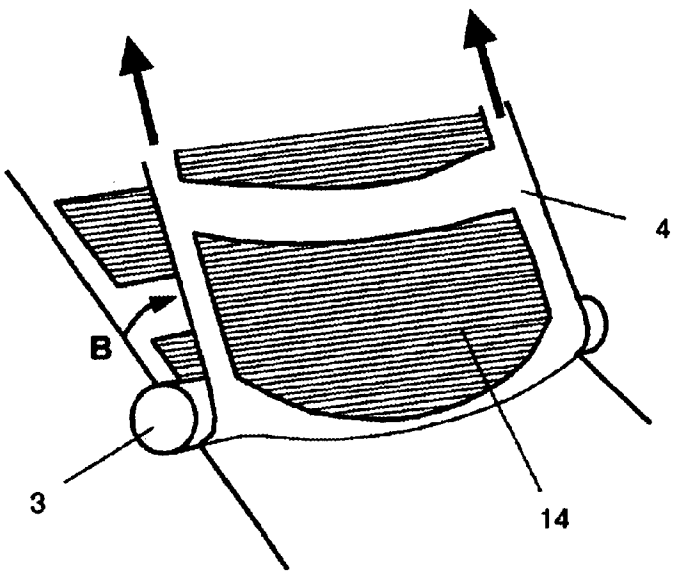
Prior Art Fig. 4
FIG. 4 is a perspective view showing product lift-up during separation of the waste matrix by a conventional peeling roller.
Figure 3:
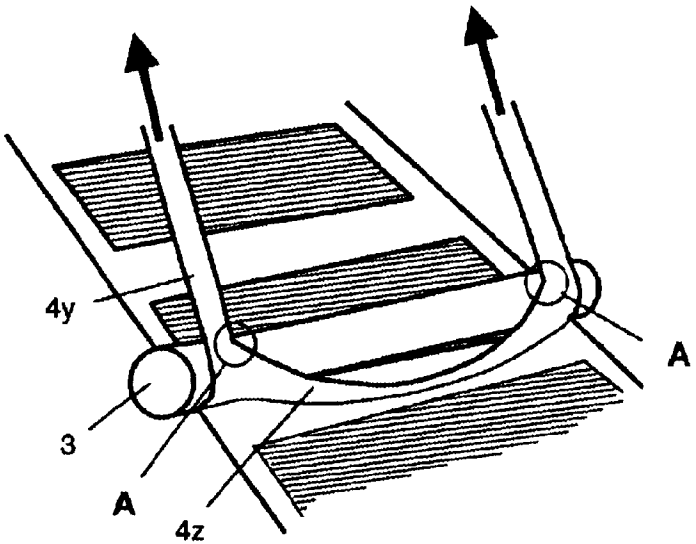
Prior Art Fig. 3
FIG. 3 is a perspective view of a waste matrix peeled by a conventional waste peeling roller.
Figure 6:
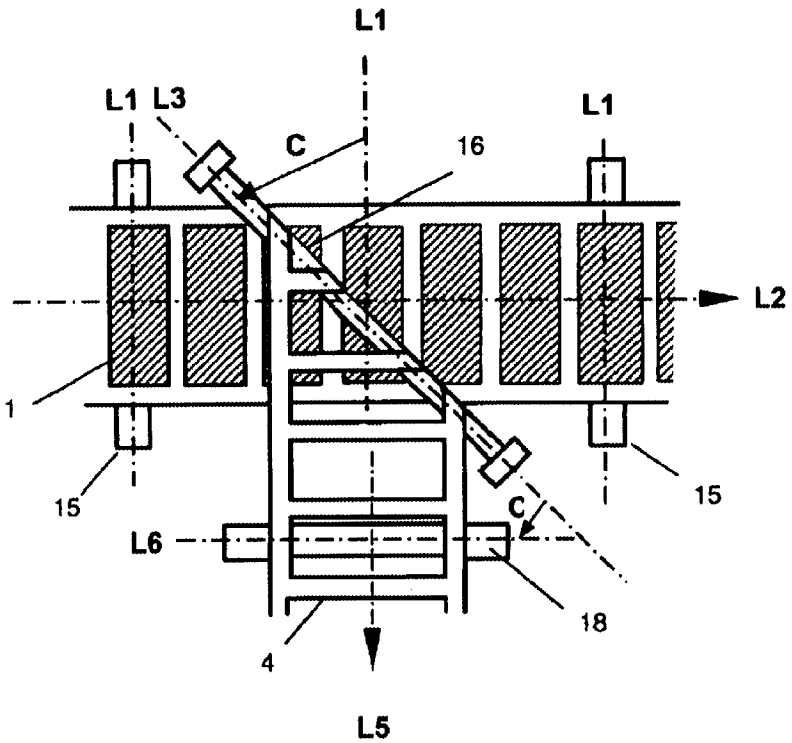
FIG. 6 is a top view of a waste peeling apparatus showing a diagonal peeling member.
Figure 5:
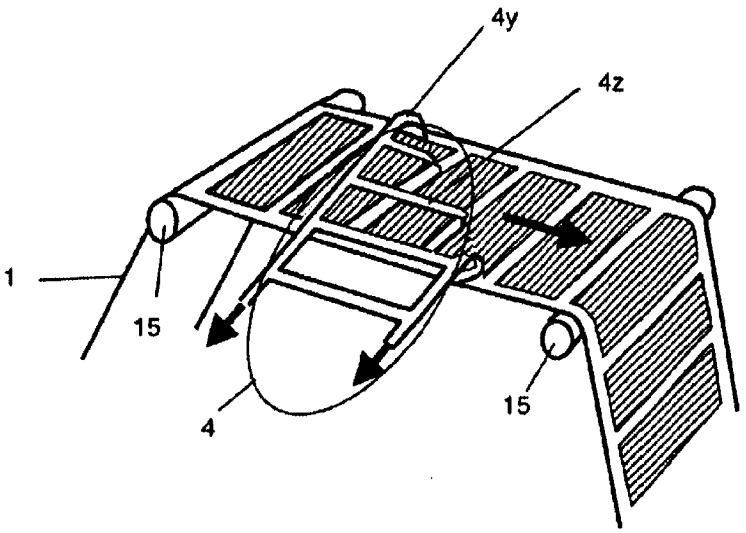
FIG. 5 is a schematic representation of a first embodiment of the present invention illustrating diagonal separation of the waste matrix.
Figure 7:
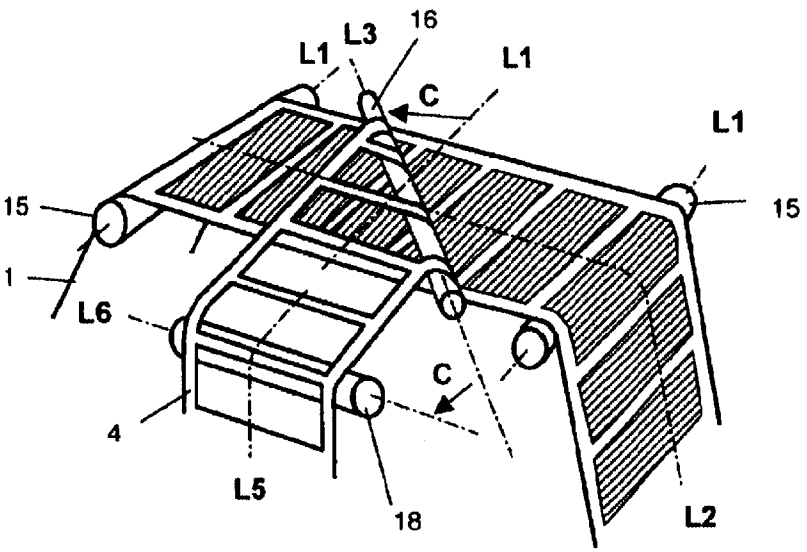
FIG. 7 is a perspective view of the waste peeling apparatus shown in FIG. 6.

A first embodiment of the present invention is illustrated in FIGS. 5 through 7. Description of such common parts as the web transport mechanism before and after waste matrix separation has been omitted. A peeling member or stripper 16 is used to stabilize the peeling position and diagonally separate the waste matrix 4 while applying appropriate tension to the waste matrix 4. The axial direction of the mutually parallel guide rollers 15 for web 1 is reference L1. Web 1 constantly advances in direction L2 perpendicular to axial direction L1. In order to separate the waste matrix 4 between the guide rollers 15 where the tension on web 1 is stable at an angle not parallel to reference L1, peeling member 16 is disposed in place of the prior art peeling roller 3 (shown in FIG. 3) to peel the waste matrix 4 at a reference axis L3, biased at an angle C to reference axis L1. That is, where the prior art peeling roller 3 separates the waste matrix 4 at an angle C of zero degrees, peeling member 16 is positioned diagonally at angle C.

The peeling member or stripper 16 in this first embodiment is a straight shaft, as shown in the FIGURES. However, the peeling member need not be limited to a straight shaft. Furthermore, while the surface of peeling member 16 ideally has zero friction, friction is in reality always present. The surface of peeling member 16 may be treated with a low co-efficient of friction coating, such as a fluororesin coating, to achieve low surface friction. It is also possible to reduce the effects of friction by using a rotating roller configuration.

For applications, where the waste matrix 4 is transported to a take-up reel or other device for further processing, the waste matrix 4 can be supplied perpendicularly to the axis L6 of a waste guide roller 18, which is positioned downstream of the peeling member 16. The waste matrix 4 moves in direction L5. The waste guide roller 18 is positioned laterally sideways from an edge of web 1. Constantly supplying the waste matrix 4 to the waste guide roller 18 perpendicularly to axis L6 and fixing the transportation direction L5 is conditional upon peeling member 16 evenly contacting the entire width of web 1 at the time of waste separation. Peeling member 16 is disposed so that web 1 does not twist, that is, positioned so as to not impede the advancement of web 1, and the circumference of peeling member 16 about axis L3 is uniform so that contact of peeling member 16 with web 1 is a straight line.

If axis L6 of waste guide roller 18 is positioned so that the angle between axis L6 and axis L3 of peeling member 16 is equal to the angle between reference L1 and axis L3, i.e., so that they both form angle C in FIGS. 6 and 7, and the waste guide roller 18 is additionally positioned parallel to axis L6, the waste matrix 4 will, after being separated by peeling member 16, be transported along direction L5 perpendicular to axis L6 of the waste guide roller 18. That is, waste matrix 4 is transported in a direction advancing perpendicular to waste guide roller 18 disposed after peeling member 16. It should be noted that if the adhesive side of waste matrix 4 contacts waste guide roller 18, the roller 18 surface should be treated to prevent adhesion by coating it with a fluororesin or knurling the surface.

Peeling member 16 is positioned in this first embodiment so that angle C is 45 degrees and the waste matrix 4 separated diagonally at a 45 degree angle to web 1, and the waste guide roller 18 is positioned so that waste matrix 4 travels perpendicularly to web 1 immediately after separation. However, the peeling angle C is not limited to 45 degrees. Separating waste matrix diagonally has some degree of effect. In another embodiment, angle C is greater than zero degrees and less than 45 degrees. In another embodiment, angle C is >45 degrees.

Some label and waste matrix configurations are more susceptible to peeling the product from the web, in addition to the waste matrix. Not only does peeling the product together with waste matrix 4 not fulfill the function of a waste stripping device to peel only the waste matrix 4, it also causes variation in waste matrix 4 tension and makes the peeling operation unstable.

Furthermore, if the position of waste matrix 4 shifts during separation, waste matrix 4 can lose contact with peeler or stripper 16 and therefore, be easily torn. Preferably, the stripping position should be stable at all times.

The embodiments shown in FIGS. 11A and 11B were conceived with consideration for these problems, and an object of these embodiments is to significantly improve operability and productively by dramatically reducing peeling of the product (i.e. label) in conjunction with stripping waste matrix 4 regardless of the shape of waste matrix 4 in an apparatus for diagonally stripping waste matrix by means for stripping member 16, thereby enabling the waste matrix 4 to always be stripped and rewound in the same condition.

A means whereby these embodiments achieve these objects is described below. That is, by combining a plurality of members 16*a,* 16*b,* such as parallel circular shafts to form the stripping member 16 and appropriately selecting the shape of each member 16*a,* 16*b,* both good waste matrix 4 peeling characteristics and smooth guide characteristics can be achieved, and the problem of peeling the product with the waste matrix 4 can be greatly reduced.

As shown in FIGS. 11A, 11B, stripping member 16 in this embodiment comprises two round shafts 16*a,* 16*b,* the diameter of shaft 16*a* being somewhat small and the diameter of shaft 16*b* being somewhat large. By using a small diameter, that is, a small curvature, shaft 16*a,* stripping of seals, labels or other product when waste matrix 4 is stripped can be significantly reduced. Because the stripped waste matrix 4 then follows the large diameter shaft 16*b,* the waste matrix 4 can be smoothly guided and advanced. It is therefore possible to achieve with an extremely simple configuration both good peeling characteristics and smooth guide characteristics, characteristics that can not be achieved with a stripping member 16 comprising a single round shaft.

It should be noted that this embodiment uses two round shafts but should not be limited to two shafts. In addition, the members 16*a,* 16*b* should not be limited to round shafts, and a combination of appropriately shaped blades could be used. Also, the shafts could be fixed, rotatable, or one could be fixed and the other rotatable.

Figure 13A:
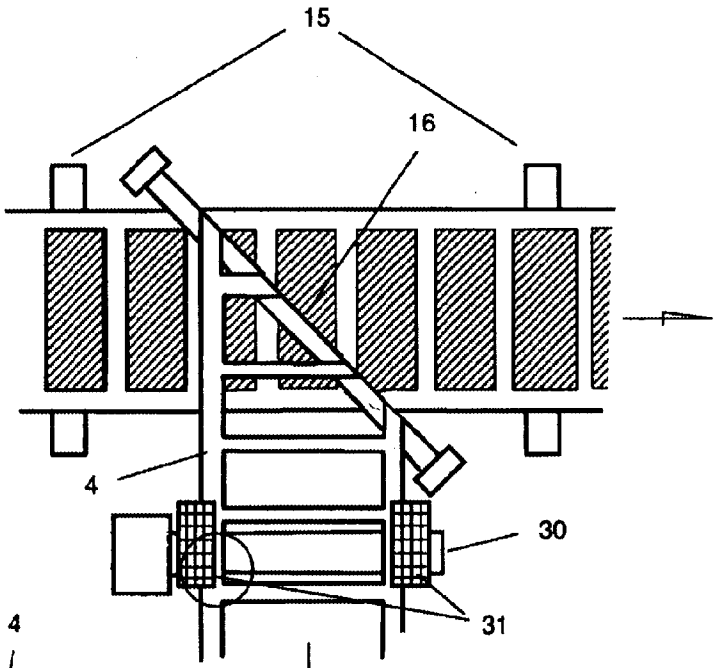
FIGS. 13A and 13B are a top view and an enlarged partial view showing an adjustable two part roller for contacting the edges of waste matrix.
Figure 13B:
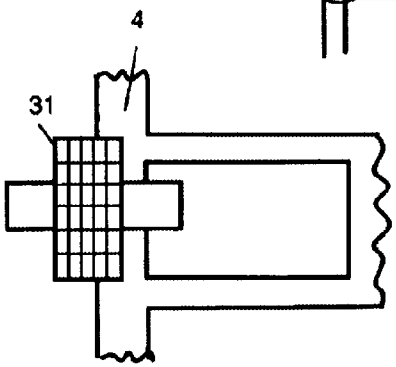

Uniform contact at a constant position must be consistently maintained by means of guide rollers 15 to strip waste matrix 4, but the waste matrix 4 easily separates from the stripping member 16 when there is a strong tendency for widthwise contraction of waste matrix 4 as shown in FIG. 12. Tension thus becomes unstable and waste matrix breaks occur easily. Particularly when the waste matrix 4 is die cut to a shape with thick cross members 4*z,* the weight of cross members 4*z* causes the waste matrix 4 to twist easily after it is peeled and there is a strong tendency for the width of the waste matrix 4 to contract. As a result, the web waste easily separates from the stripping member 16. Waste matrix 4 tension thus becomes unstable and the waste matrix 4 breaks easily. To continue stably peeling, the waste matrix stripping position must remain stable and the waste matrix 4 must stay in contact with the stripping member 16 at all times. However, waste matrix 4 differs from the normal web 1 in that there is a strong tendency for widthwise contraction because spaces form much of the waste matrix 4, and it is difficult to eliminate this widthwise contraction if the waste matrix 4 is advanced only by applied tension. This tendency to contract widthwise is eliminated, however, by using a split two-part roller 31 (see FIGS. 13A, 13B) contacting only both edges of the waste matrix on the waste feed drive roller 31 that advances the waste matrix 4 while applying stripping tension, and stability is yet further improved by taking up the waste matrix 4 using a surface rewinding method. However, by contacting only both edges of the waste matrix 4 with a two part roller 31 at the waste feed drive roller 30, which applies stripping tension while advancing the waste matrix 4 as shown in FIGS. 13A, 13B, the position of the waste matrix 4 on stripping member 16 remains stable and the waste matrix 4 can be advanced at a constant width even when there is a strong tendency for widthwise contraction. As a result, the problem of breaks resulting from unstable tension caused by this tendency to contract can be significantly improved. The two part roller 31 is constructed so that it can be adjusted according to the width of waste matrix 4 to a position contacting only both edges of the waste matrix, and because the adhesive side of the waste matrix 4 contacts the two part roller surface, the two part roller 31 is treated for adhesion resistance so the waste matrix 4 does not stick to the two part roller surface. This creates a pulling action only on both edges of the waste matrix 4, preventing the waste matrix 4 from shrinking, stabilizing the position of the waste matrix 4 on stripping member 16 because the waste matrix 4 is advanced while maintaining its original shape, and thus advancing the waste matrix 4 with a constant width, even when the waste matrix 4 has a strong tendency to contract widthwise.

Figure 16:
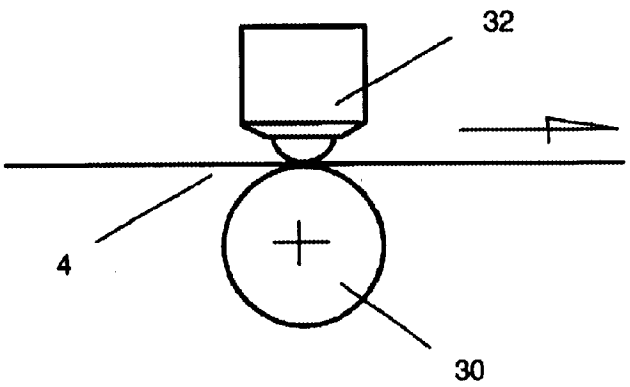
FIG. 16 is a side view of a ball plunger feed mechanism for applying surface pressure to both edges of waste matrix.

While this embodiment describes a mechanism for advancing the waste matrix 4 while applying surface pressure only to both edges of the longitudinal member 4*y* of the waste matrix 4 by means of an adjustable two part roller 31, this embodiment should not be limited to a two part roller insofar as the configuration enables the waste matrix 4 to be advanced while applying surface pressure to both edges 4*y* of the waste matrix 4. For example, the waste matrix 4 can be advanced while applying surface pressure to both longitudinal member 4*y* edge parts using a ball plunger 32 as shown in FIG. 16.

Furthermore, a diagonal peeling type handling apparatus is used in this embodiment, but the invention should not be limited to a diagonal peeling type waste handling apparatus and can be applied to all common waste stripping devices.

Furthermore, because the tension on the waste stripping part 16 must be stable in order to stably peel the waste matrix 4, it is necessary to minimize interference between the stripping tension and the tension for taking up the waste matrix 4 when rewinding the stripped waste matrix 4. In other words, a certain tension buffer is needed, and a surface drive method is used for the take-up method to yet further improve stability.

A further object is to assist with the disposal of waste, which becomes bulky with convention manual waste peeling, by stably rewinding the waste matrix into a roll after the waste matrix has been peeled.

Preferably, the waste matrix 4 must be in constant contact with the stripping member 16 when the waste matrix 4 is stripped in order to stably diagonally peel the waste matrix 4 by means of a stripping member 16 or other intervening member. However, depending upon the waste matrix 4, the waste matrix 4 tends to easily separate from the stripping member 16, as shown in FIG. 12 as the waste matrix 4 advances, if the position of the stripping member 16 and the position of the guide part 18 including rewinding parts other than the stripping member 16 are fixed. This occurs, for example, when the waste matrix 4 has a tendency to contract from its normal width due to the effects of adhesive and the die cut shape of the waste matrix 4 even though a predetermined tension is applied to the waste matrix 4.

In other words, as shown in FIG. 12, if the stripping member 16 is disposed to reference L3 at an angle of C1 to guide reference L1 of the web 1, and C2 is the angle between the stripping member 16 and guide reference L6 of the waste guide roller 18 guiding the stripped waste matrix 4, installation angle C2 must be the same as installation angle C1 in order to guide a normal waste matrix 4 with a small tendency for widthwise contraction without having the waste matrix 4 wrinkle or meander. However, when the waste matrix 4 is characterized by a tendency to contract widthwise, the waste matrix 4 will also to tend to partially separate at B from the stripping member 16 if angles C1 and C2 are the same. Once the waste matrix 4 loses contact with the stripping member 16 stripping member 16 ceases to regulate movement of waste matrix 4. The waste matrix 4 thus twists in part and tends to break easily.

Significant tension must be constantly applied to the waste matrix 4 in this case in order to maintain contact with the stripping member 16, but some types of waste matrix 4 tear easily and sufficient tension can not be applied to maintain the waste matrix 4 in contact with stripping member 16.

To achieve these objects, one embodiment of the present invention enables the installation angle C2 formed by stripping member reference L3 and post-stripping guide roller reference L6 to be adjusted relative to the installation angle C1 formed by the guide reference L1 of web 1 and stripping member reference L3. By then adjusting the position according to the waste matrix 4 to maintain constant contact and apply appropriate tension according to waste matrix 4, stable waste matrix 4 stripping can be achieved.

Figure 17:
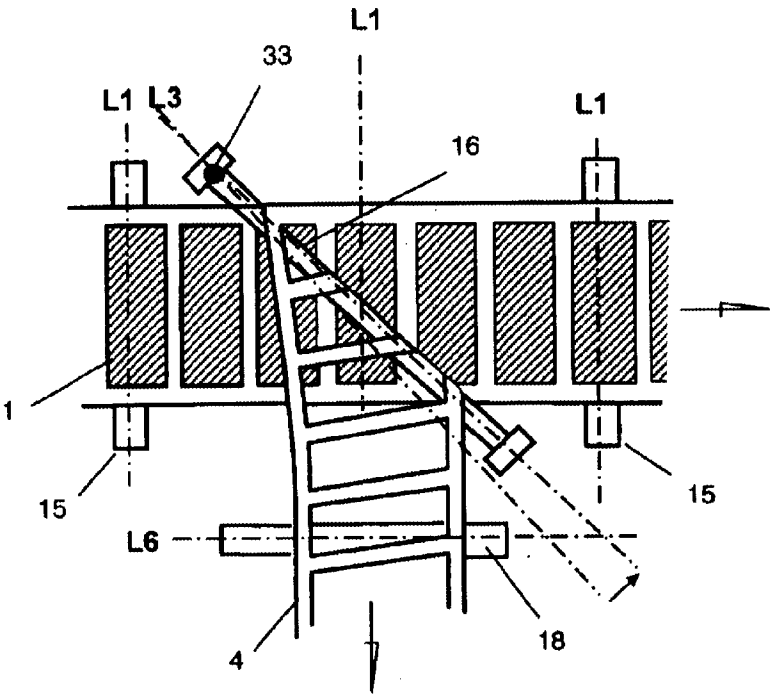
FIG. 17 is a top view showing an adjustable peeling member for use with waste matrix having a tendency for widthwise contraction.

As shown in FIG. 17, one end of the stripping member 16 in this embodiment is a pivot point 33 and the other end is movable, thereby enabling stripping member reference L3 to be adjusted relative to guide references L1 and L6, that is, enabling C2 to be adjusted relative to installation angle C1 of stripping member 16, so that constant contact can be maintained between the waste matrix 4 and stripping member 16. By keeping even waste matrix 4 with a tendency to contract widthwise in constant contact with the stripping member 16 as shown in FIG. 17, tension is stable and, as a result, the waste matrix 4 is stably advanced with the width thereof contracted and narrowed. The construction of the stripping member 16 in this embodiment is adjustable so that C2 is variable relative to installation angle C1, but the mechanism for adjusting angle C2 relative to angle C1 should not be so limited. For example, the same effect can be achieved if the stripping member 16 is fixed and post-stripping guide reference L6 is adjustable relative to stripping member reference L3. The same effect could also be achieved if the pivot point 33 were at the other end of stripping member 16.

Figure 8:
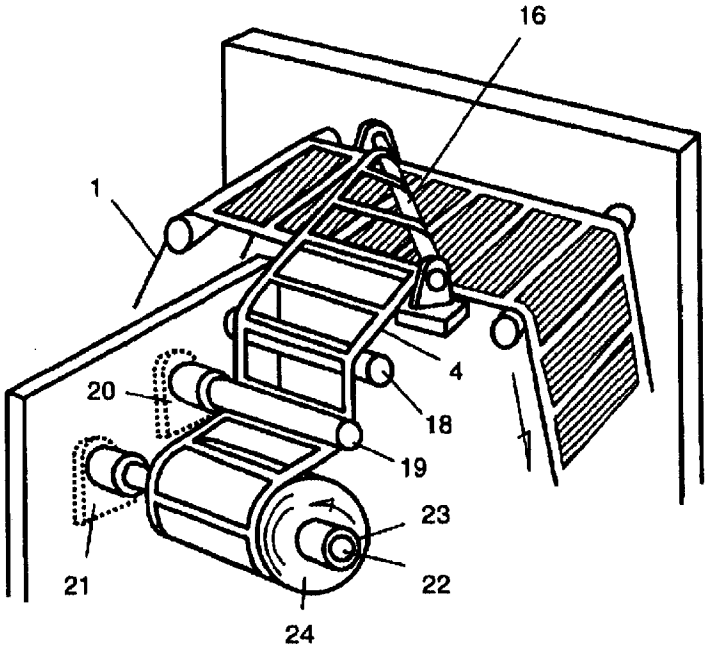
FIG. 8 is a perspective view of a shaft driven waste take-up apparatus for use with a diagonal waste peeler.

FIG. 8 shows a first embodiment of a waste take-up apparatus using a peeling member 16 as described above. The movement of waste matrix 4 is related to movement of web 1. Waste matrix 4 is stably advanced by a waste feed roller 19 that is synchronized to the transportation of web 1 to maintain an appropriate tension. Mechanically linking the shaft of waste feed roller to the drive system transporting web 1 is the simplest way to consistently synchronize the waste matrix 4 with the web 1. However, if it is necessary to fine tune the tension applied to waste matrix 4, a waste feed motor 20, that is, a drive system independent of the drive system advancing web 1, can be used to adjust the tension by changing the speed of waste feed roller 19 relative to the speed of web 1. It is also possible to adjust the tension using a torque motor that arrests rotation when a load exceeding the torque setting of the waste feed motor 20 is applied. Waste feed roller 19 is a means for transporting the waste matrix 4 while constantly maintaining appropriate tension on waste matrix 4. However, the drive method is not limited to a waste feed roller 19 as shown in FIG. 8, and can be positioned immediately after peeling member 16.

Figure 9:
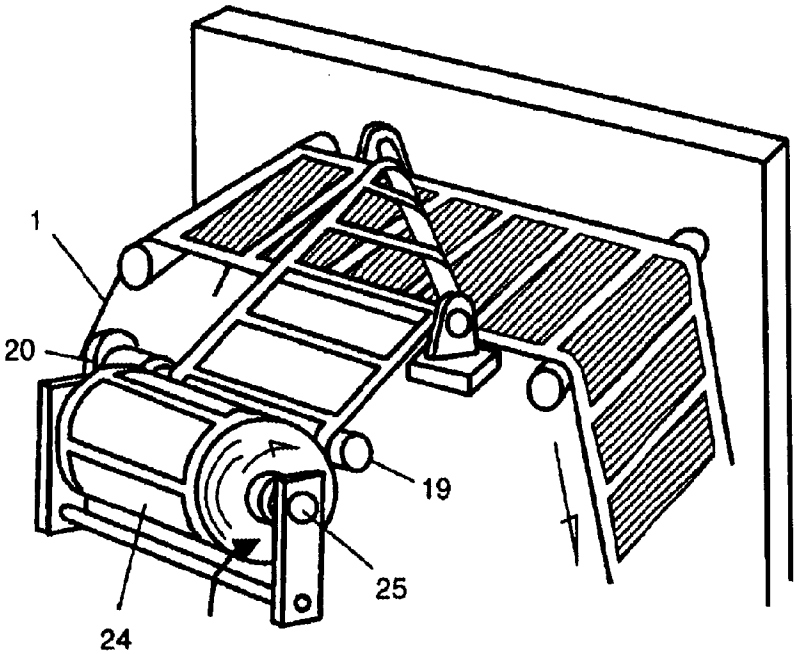
FIG. 9 is a perspective view of a surface drive waste take-up apparatus for use with a diagonal waste peeler.

The waste guide roller 18, waste feed roller 19 and waste roll 24 may be positioned below the plane of web 1, as shown in FIGS. 8 and 9.

In order to ultimately make the waste matrix 4 compact, it is wound around a waste take-up core 23 mounted on a waste take-up shaft 22 driven by a torque motor or other waste rewinding motor 21, thus forming waste roll 24. In this embodiment, waste feed roller 19 and waste take-up shaft 22 are independent, but could be the same. For example, if waste feed roller 19 is driven by a torque motor, direct take-up using the waste feed roller 19 as the take-up shaft is possible.

The take-up method shown in FIG. 8 is known as a center shaft take-up method whereby a waste re-winding motor 21 directly drives a waste take-up shaft 22 and forms waste roll 24. As shown in FIG. 9, it is alternatively possible to use a surface drive take-up method in which the outside surface of waste roll 24 is pressed against the outside surface of waste feed roller 19 operating in conjunction with web 1. Waste roll 24 rotates freely on support shaft 25 so that rotation of waste roll 24 freely follows waste feed roller 19 to continuously form a roll of waste matrix 4. An advantage of this rewinding method is that, compared with a so-called shaft rewinding method (FIG. 8) in which waste take-up shaft 22 is driven to directly rewind the waste matrix 4 onto the shaft and form waste roll 24, the roll surface can constantly be kept smooth and the waste matrix take-up tension kept stable because contact pressure with the waste roll surface is constantly maintained to form the waste roll 24. It is therefore possible to prevent breaks in the waste matrix 4 resulting from unstable rewinding tension caused by roll surface irregularities.

Figure 10:
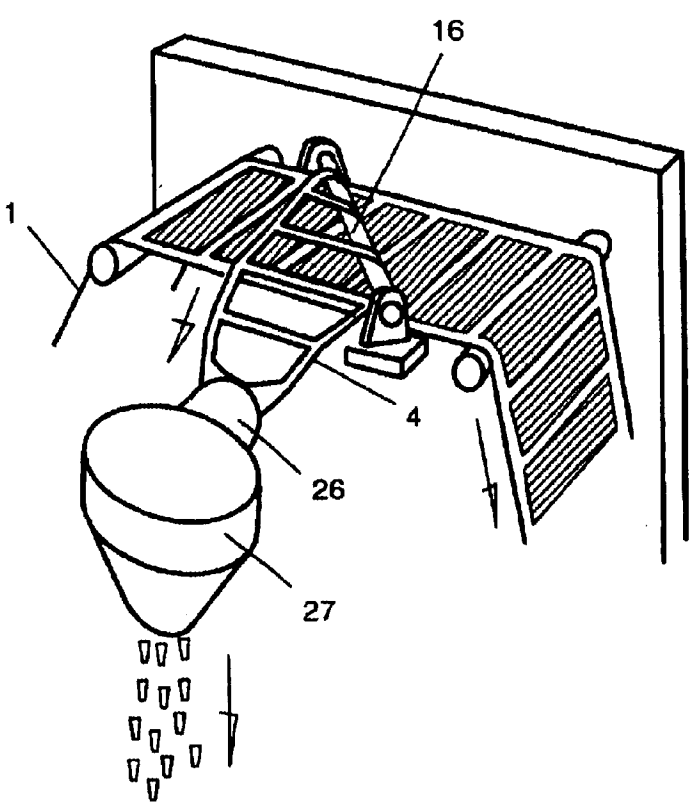
FIG. 10 is a perspective view of a waste processor for suctioning and comminuting waste matrix.

The above is an example in which, after the waste matrix 4 is separated by peeling member 16, waste matrix 4 is transported along direction L5 and is ultimately taken up. However, application of the present invention is also possible in conjunction with a system in which peeling tension is generated by suction with a blower 26, for example, disposed directly after the peeling member 16, as shown in FIG. 10. The waste matrix 4 is then input to a shredder 27 after being steadily separated by peeling member 16.

Yet further, while the prior art can require some means of strengthening the waste by increasing the width of the waste part or including fibers, for example, to prevent waste breakage, using a peeling apparatus according to the present invention makes such measures unnecessary. As a result, the present invention makes it easy to lower material costs, that is, conserve resources, and thus also reducing the absolute amount of waste, which contributes greatly to the waste handling problem.

Figure 14:
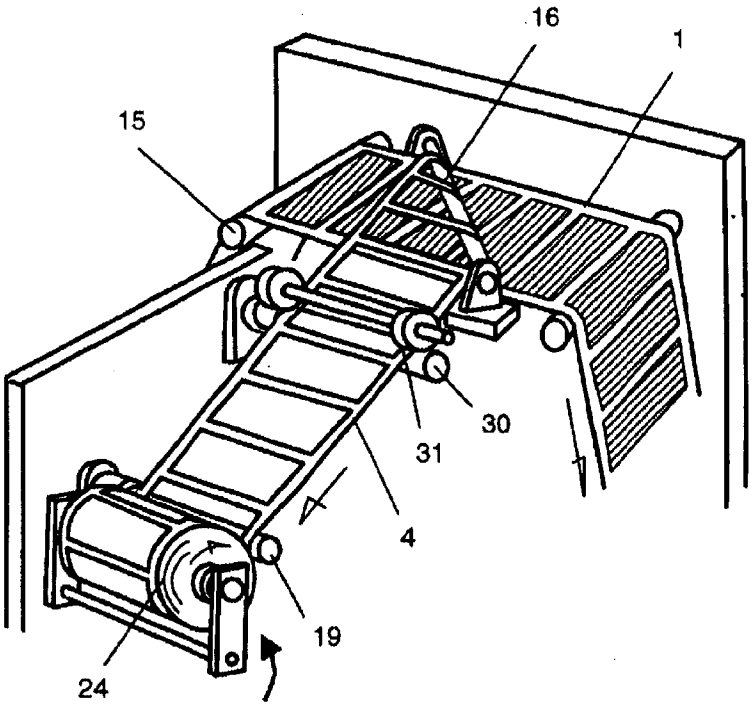
FIG. 14 is a perspective view of a surface drive waste take-up apparatus for use with a diagonal waste peeler.
Figure 15:
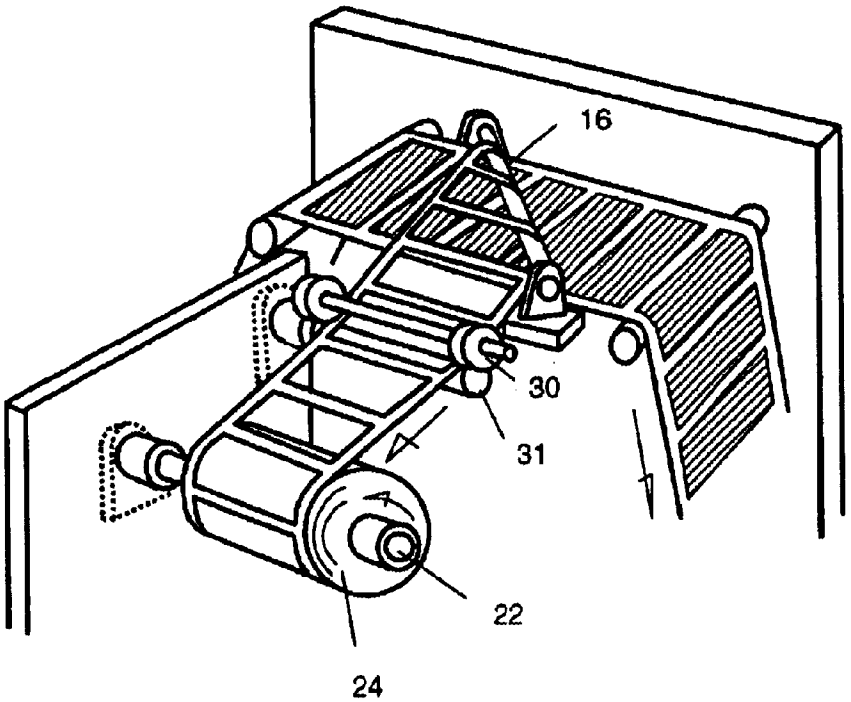
FIG. 15 is a perspective view of a shaft driven waste take-up apparatus for use with a diagonal waste peeler.

While it is sufficient to apply appropriate tension to the waste matrix 4 and take up the waste matrix after waste matrix 4 passes the waste feed drive roller 30 and two part roller 31, this embodiment uses a surface rewinding method whereby the surface of roll 24 shown in FIG. 14 applies contact pressure to the outside of the waste winding drive roller 19. This rewinding method can produce stable winding tension using a speed difference between the waste feed drive roller 30 and the waste rewinding drive roller 19. Furthermore, an advantage of this surface rewinding method is that, compared with a shaft rewinding method where a rewind shaft 22 is driven to directly rewind the waste matrix 4 onto that shaft and forms roll 24 as shown in FIG. 15, the roll surface can constantly be kept smooth and the waste take-up tension stable because contact pressure with the waste roll surface is constantly maintained to form the waste roll 24. It is therefore possible to prevent breaks in the waste matrix 4 resulting from unstable winding tension caused by roll surface irregularities.

As will be known from the above description, a significant increase in the stripping speed of a diagonal peeling type waste handling apparatus is possible because the problem of the seal, label or other product peeling at the same time can be significantly reduced by combining a plurality of members 16*a,* 16*b* for the stripping member 16 with applying surface pressure to both edges 4*y* of the waste matrix 4. Furthermore, while the prior art is limited to stripping waste matrix 4 with a small tendency for widthwise contraction, this embodiment significantly increases the range of products that can be stably stripped because even goods with a strong tendency for widthwise contraction can be stably diagonally stripped by contacting only both edges of the waste matrix 4 using a two part roller 31.

Furthermore, by using a surface rewinding method to stably take up the stripped waste matrix 4, a conventional diagonal peeling type waste handling apparatus can be achieved as a more stable, higher speed diagonal peeling type waste rewinding system with a wide range of applications. In addition, with a waste matrix 4 that conventionally can not be stripped and wound by machine and is handled manually, the stripped waste is bulky and impossible to make small because one side of the waste is coated with adhesive, and waste disposal is therefore a major problem. However, by highly efficiently rewinding the waste into a small roll, the present invention helps significantly reduce the effort, time and cost required for waste disposal.

When waste matrix 4 is peeled by stripping member 16, they must constantly contact with the same force, that is, the tension applied to strip the waste matrix 4 must be constant. When the waste matrix 4 is taken up or otherwise processed after it is stripped, it is preferable to reduce as much as possible interference with the waste matrix tension immediately after stripping in order to eliminate the possibility of waste matrix tension pulses produced by the take-up part adversely affecting stripping. Stripping tension in this embodiment is applied by a waste feed drive roller 30 shown in FIG. 18 driving at a speed achieving constant tension on the waste matrix 4 after it is stripped. This roller 30 can be driven by a variable speed motor 21 or by mechanical linkage from the drive part connected to web 1 transportation. Other methods can be used for applying tension to the waste matrix 4, including the drive torque of the waste feed roller drive roller 30, and the method used should not be limited insofar as the mechanism can apply consistent tension to the waste matrix 4.

Figure 18A:
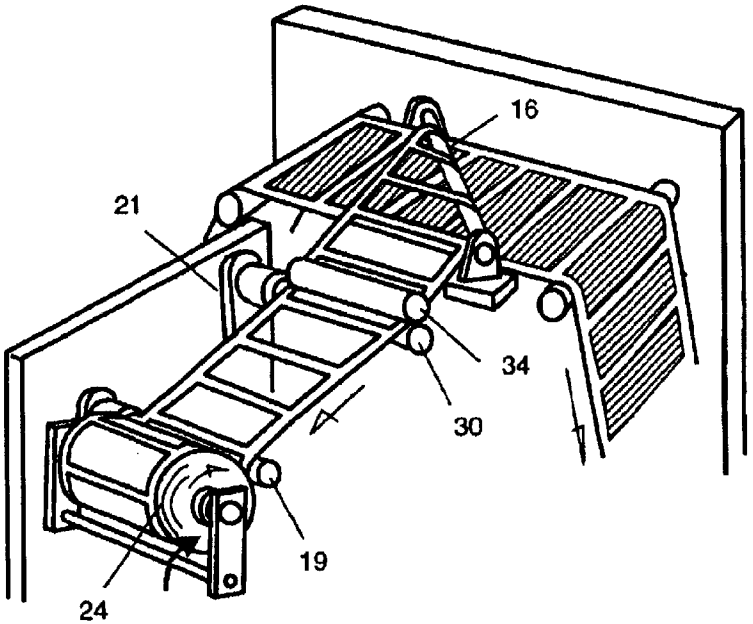
FIG. 18A is a perspective view of a surface drive waste take-up apparatus with a mechanism for reducing tension interference.
Figure 18B:
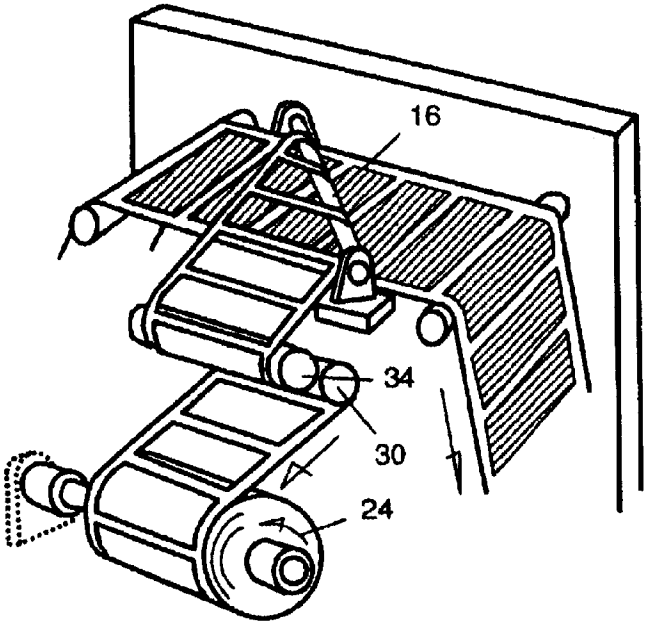
FIG. 18B is a perspective view of a shaft driven waste take-up apparatus with a mechanism for reducing tension interference.

So that waste feed roller 30 applies stripping tension to the waste matrix 4 and the tension effect downstream from this roller 30 is simultaneously reduced, a pressure roller 34 presses against the waste feed drive roller 30 in this embodiment. The surface of the pressure roller 34 is treated for adhesion resistance because the adhesive side of the waste matrix 4 contacts the roller surface. By using pressure roller 34 in this embodiment, interference with the stripping member 16 and tension thereafter is reduced, but the method for reducing interference with the waste should not be so limited. For example, a certain tension buffering effect can be achieved by increasing the winding angle of waste matrix 4 around the surface of waste feed drive roller 30 instead of using pressure roller 34. Using pressure roller 34 immediately after the waste stripper 16 somewhat insulates the tension at the waste stripper 16 and the tension downstream from the pressure 34. If the pressure roller 34 is not used, a certain tension insulation effect can still be achieved by increasing the wrap angle to the waste feed drive roller 30 as shown in FIG. 18A.

Figure 19:
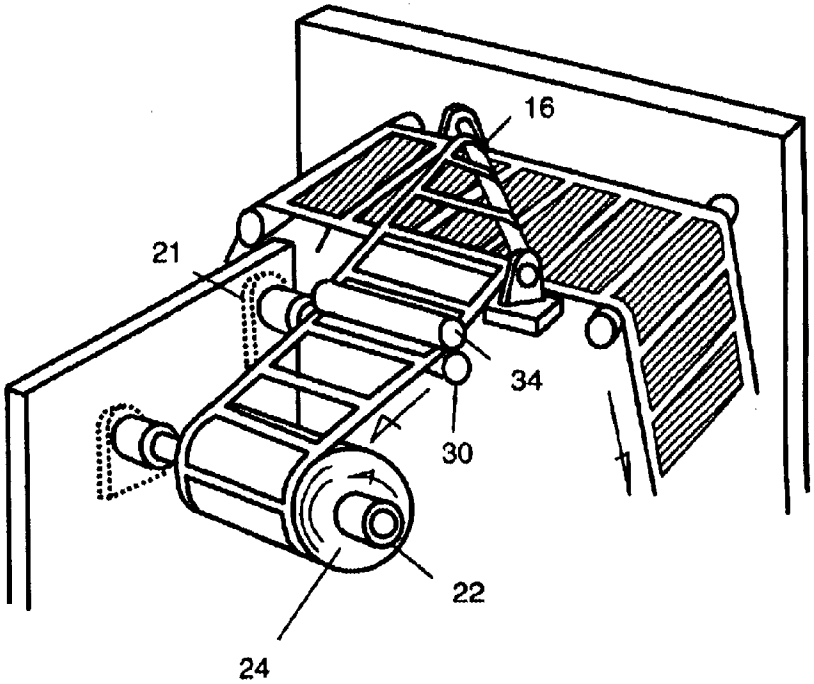
FIG. 19 is a perspective view of a shaft driven waste take-up apparatus with a mechanism for reducing tension interference.

While it is sufficient to apply appropriate tension to and take up the waste matrix 4 after the waste matrix 4 passes the waste feed drive roller 30 and pressure roller 34, the present embodiment uses a surface rewinding method whereby the outside of the waste rewinding drive roller 19 applies contact pressure against the surface of waste roll 24. An advantage of this rewinding method is that, compared with a shaft rewinding method (FIG. 19) in which a rewind shaft is driven to directly rewind the waste matrix 4 onto the shaft and form roll 24, the roll surface can constantly be kept smooth and the waste take-up tension stable because contact pressure with the waste roll surface is constantly maintained to form the waste roll 24. It is therefore possible to prevent breaks in the waste matrix 4 resulting from unstable rewinding tension caused by roll surface irregularities.

As will be known from the above description, by maintaining constant contact with the stripping member 16 according to the shape of the waste matrix 4 by means of a configuration enabling adjustment of the installation angle C2 formed by stripping member reference L3 and post-stripping guide roller reference L6 to the installation angle C1 formed by the stripping member reference L3 and guide reference L1 of web 1, and by using a configuration that reduces interference between the tension of the waste stripping part and the tension of the waste take-up part, the possibility of breaks resulting from the slack that can occur in the waste matrix 4 at the stripping member 16 can be greatly reduced. Therefore, while a conventional diagonally waste peeling apparatus is limited to stripping web waste with a small tendency for contraction widthwise to the waste, the present embodiment greatly increases the range of goods that can be stably peeled.

Furthermore, by using a surface rewinding method to consistently take up the stripped waste matrix 4, the stability and speed of the diagonal stripping type waste take-up can be improved. It is therefore possible to more actively utilize the advantages of the convention diagonal stripping type waste take-up apparatus, and a system with higher reliability can be achieved.

In accordance with the preceding description, by disposing peeling member 16 so that separation occurs diagonally to the direction of web travel L2, cross member 4*z* can be separated evenly with substantially no delay to longitudinal member 4*y* of hole filled waste matrix 4, thereby dramatically reducing the possibility of the breaks in waste matrix 4 that occur so easily with prior art separation methods.

Furthermore, because separation can be accomplished at an acute angle and the problem of the product being picked up with the waste matrix can be simultaneously resolved, it is also possible to produce products of shapes that can not be peeled with the prior art. Therefore, in contrast with the prior art, that is, the current status in which the full capacity of the overall process can not be used and production is inefficient because the speed is limited at the waste peeling apparatus to a speed at which waste matrix 4 will not break, a waste peeling apparatus according to the present invention provide at low cost, a speed increase resulting from stabilizing the peeling operation, and a significant improvement in productivity as a result of an increase in the web transportation speed in conjunction therewith.

Furthermore, because a waste peeling apparatus according to the present invention can stably peel or separate at high speed waste matrix that is normally manually peeled by workers because the shape of the waste matrix is one that can not be peeled by a conventional waste peeling apparatus, significant labor and cost reduction can be achieved. In addition, because the waste matrix can be made into a compact roll if a waste take-up device is added, the size of the waste, which is particularly bulky after manual peeling and thus a particular problem with the prior art, can be significantly reduced, and waste handling can thus be made easier.

Having described the invention, what is claimed is:

1. A stripper for separating a waste matrix from a moving web, the stripper comprising:

a waste matrix peeler positioned at a skewed angle to the direction of travel of the web; and a waste matrix guide member positioned laterally sideways from an edge of the web, wherein the waste matrix guide member is positioned below a plane in which the web travels, the waste matrix peeler being positioned above the plane in which the web travels.

2. A stripper for separating a waste matrix from a moving web, the stripper comprising:

a waste matrix peeler positioned at a skewed angle to the direction of travel of the web;

a waste matrix guide member positioned laterally sideways from an edge of the web; and means for wrapping the waste matrix more than 180° around the waste matrix peeler, wherein the means for wrapping comprises:

at least one roller, over which the waste matrix travels after traveling around the waste matrix peeler, the at least one roller being positioned below a plane in which the web travels; and the waste matrix peeler being positioned above the plane in which the web travels.

3. A stripper for separating a waste matrix from a moving web, the stripper comprising:

a waste matrix peeler positioned at a skewed angle to the direction of travel of the web; and a waste matrix guide member positioned laterally sideways from an edge of the web, wherein the waste matrix peeler comprises: a first peeler member having a first cross-sectional size; and a second peeler member positioned proximate the first peeler member, the second peeler member having a second cross-sectional size, the second cross-sectional size being larger than the first cross-sectional size, the waste matrix traveling over the first peeler member prior to traveling over the second peeler member.

4. The stripper according to claim 3, wherein the second peeler member is positioned vertically above the first peeler member.

5. A stripper for separating a waste matrix from a moving web, the stripper comprising:

a waste matrix peeler positioned at a skewed angle to the direction of travel of the web; and a waste matrix guide member positioned laterally sideways from an edge of the web; and means for maintaining tension on the waste matrix after separation, wherein the means for maintaining tension comprises: a waste matrix driver for driving the waste matrix, the waste matrix driver driving the waste matrix only at the edges of the waste matrix.

6. The stripper according to claim 5, wherein the waste matrix driver comprises two drive rollers positioned against a first side of the waste matrix and a drive roller positioned against a second side of the waste matrix.

7. The stripper according to claim 5, further comprising:

a waste matrix take-up device; and a means for isolating tension from the waste matrix take-up device from the waste matrix contacting the waste matrix peeler.

8. The stripper according to claim 7, wherein the means for isolating tension comprises a pair of rollers, one roller contacting a first side of the waste matrix, the other roller contacting the second side of the waste matrix, one roller being driven, the other roller being freely rotatable, the rollers being between the waste matrix peeler and the waste matrix take-up device.

9. A stripper for separating a waste matrix from a moving web, the stripper comprising:

a waste matrix reeler positioned at a skewed angle to the direction of travel of the web;

means for adjusting the angle between an axis of the waste matrix peeler and an axis of the waste matrix guide member; and a waste matrix guide member positioned laterally sideways from an edge of the web, wherein one and only one of the waste matrix peeler and the waste matrix guide member is pivotable.

10. The stripper according to claim 9, further comprising:

means for wrapping the waste matrix more than 18020 around the waste matrix peeler.

11. The stripper according to claim 10, wherein the means for wrapping comprises:

a waste matrix take-up device for rolling the waste matrix into a roll, the waste matrix take-up device being position below a plane in which the web travels; and the waste matrix peeler being positioned above the plane in which the web travels.

12. The stripper according to claim 9, further comprising:

a means for maintaining tension on the waste matrix after separation.

13. The stripper according to claim 9, wherein the skewed angle between the waste matrix peeler and a line perpendicular to the direction of travel of the web is fixed.

14. A stripper for separating a waste matrix from a moving web, the stripper comprising:

a waste matrix peeler positioned at a skewed angle to the direction of travel of the web;

a waste matrix guide member positioned laterally sideways from an edge of the web;

a waste take-up device for rolling the waste matrix into a roll; and a drive roller for rotating the waste take-up device, the drive roller being in contact with the waste matrix rolled about the waste take-up device.

15. A stripper for separating a waste matrix from a moving web, the stripper comprising:

a first waste matrix peeler having a first cross-sectional size; and a second waste matrix peeler positioned proximate the first waste matrix peeler, the second waste matrix peeler having a second cross-sectional size, the second cross-sectional size being larger than the first cross-sectional size, the waste matrix traveling over the first waste matrix peeler prior to traveling over the second waste matrix peeler, wherein the first and second waste matrix peelers are stationary.

16. The stripper according to claim 15, wherein the first and second waste matrix peelers are positioned at the same skewed angle to the direction of travel of the web.

17. The stripper according to claim 15, wherein the first and second waste matrix peelers have circular cross-sections.

18. The stripper according to claim 15, wherein the first and second waste matrix peelers are rotatable.

19. A stripper for separating a waste matrix from a moving web, the stripper comprising:

a first waste matrix peeler having a first cross-sectional size; and a second waste matrix peeler positioned proximate the first waste matrix peeler, the second waste matrix peeler having a second cross-sectional size, the second cross-sectional size being larger than the first cross-sectional size, the waste matrix traveling over the first waste matrix peeler prior to traveling over the second waste matrix peeler, wherein one of the first and second waste matrix peelers is stationary and the other of the first and second waste matrix peelers is rotatable.

20. The stripper according to claim 19, wherein the first and second waste matrix peelers are positioned at the same skewed angle to the direction of travel of the web.

21. The stripper according to claim 19, wherein the first and second waste matrix peelers have circular cross-sections.

22. The stripper according to claim 19, wherein the first and second waste matrix peelers are rotatable.

23. A waste matrix handling system for driving a waste matrix separated from a moving web comprising:

a waste matrix driver for driving the waste matrix, the waste matrix driver driving the waste matrix only at the edges of the waste matrix, wherein the waste matrix driver comprises two drive rollers positioned against a first side of the waste matrix and a drive roller positioned against a second side of the waste matrix.

24. A waste matrix handling system for driving a waste matrix separated from a moving web comprising:

a waste matrix driver for driving the waste, wherein the waste matrix driver comprises a plurality of rotating balls positioned against a first side of the waste matrix and a drive roller positioned against a second side of the waste matrix.

25. A stripper for separating a waste matrix from a moving web, the stripper comprising:

a waste matrix peeler positioned at a skewed angle to the direction of travel of the web, the skewed angle being greater than 45 degrees.

26. The stripper according to claim 25, wherein the waste matrix is peeled about an exterior surface of the waste matrix peeler.

27. A stripper for separating a waste matrix from a moving web, the stripper comprising:

a waste matrix peeler positioned at a skewed angle to the direction of the travel of the web; and a waste matrix guide member positioned adjacent the web, the waste matrix traveling over the waste matrix guide member after traveling over the waste matrix peeler, one and only one of the waste matrix peeler and the waste matrix guide member being pivotable.

28. The stripper according to claim 27, wherein the waste matrix peeler is pivotable about an end distal from the waste matrix guide member.

29. A stripper for separating a waste matrix from a moving web, the stripper comprising:

a waste matrix peeler positioned at a skewed angle to the direction of travel of the web;

a waste take-up device for rolling the waste matrix into a roll; and a drive roller for rotating the waste take-up device, the drive roller being in contact with the waste matrix rolled about the waste take-up device.

* * * * *